United States Patent [19]

Shichida

[11] Patent Number: 4,978,310

[45] Date of Patent: Dec. 18, 1990

[54] ELECTRICAL JACK CONNECTOR

[75] Inventor: Akihito Shichida, Higashiosaka, Japan

[73] Assignee: Hosiden Electronics Co., Ltd., Osaka, Japan

[21] Appl. No.: 439,736

[22] Filed: Nov. 20, 1989

[30] Foreign Application Priority Data

Jan. 17, 1989 [JP] Japan ..... 1-4210[U]

[51] Int. Cl.[5] ..... H01R 13/703; H01R 17/18

[52] U.S. Cl. ..... 439/188; 439/668; 200/51.1

[58] Field of Search ..... 439/188, 668, 29, 30; 200/51.09, 51.1

[56] References Cited

U.S. PATENT DOCUMENTS 2,224,366 12/1940 Johnston ..... 200/51.09
4,725,239 2/1988 Shichida ..... 439/29

FOREIGN PATENT DOCUMENTS 38745 10/1981 European Pat. Off. ..... 439/188
60-42286 3/1985 Japan .

*Primary Examiner*—Gary F. Paumen

*Attorney, Agent, or Firm*—Armstrong, Nikaido, Marmelstein, Kubovcik & Murray

[57] ABSTRACT

An electrical jack assembly for connecting a rotary plug is disclosed for use in a cooking range equipped with a turntable and an oven unit, the assembly includes three main units: a sleeve unit, a casing, and a rear cover; the sleeve unit has a cylindrical sleeve with a central bore for insertion of the plug at its front; the casing incorporates two paired leaf spring contact frames, each having a contact angled inward to form two paired contacts on the plug at different longitudinal points on the plug, each contact has an oil-impregnated roller at its end, and the rollers are each arranged to contact the plug at right angles to the longitudinal axis of the plug; the rear cover is mounted with a switch unit at its rear, the switch unit includes two segments which are mounted across a center hole of the rear cover to form a contact point at a head end of the inserted plug, wherein one segment thereof is provided with an insulating plate which is exposed in the central hole to contact to the head end of the plug such that, when the plug head end contacts to the insulating plate, a switching action takes place between the two segments by insertion of the plug and retains the head end of the plug on the insulating plate during rotation of the plug.

4 Claims, 3 Drawing Sheets

ELECTRICAL JACK CONNECTOR

FIELD OF THE INVENTION

This invention relates to an electrical jack connector which retains contact with a rotary plug. In particular, this invention relates to an electrical jack connector which retains contact with a rotary plug and which acts concurrently to cause an on-off switch action, on insertion of the plug thereinto.

DESCRIPTION OF THE CONVENTIONAL ART

Conventionally, in the design of an electrical cooking range equipped with a turntable and an oven unit, for the purpose of measuring the temperature of a beef roast while cooking, a rod-shaped thermocouple is inserted into the beef to measure the inside temperature and to monitor the cooking condition. In this application, the thermocouple should turn with the beef on the turntable and therefore, a plug which is connected to the thermocouple should be also be turned. An electrical jack connector for such a purpose which requires the retention of a rotary plug has been proposed, for instance, in Japanese Unexamined Utility Model Publication Sho No. 60-42286.

On the other hand, some jacks are designed so that an insertion of a plug thereinto will form not only an electrical contact with the jack, but also cause an on-off switch action, by incorporating a switch unit in the jack assembly, in which type normally a slider device is incorporated to make sliding contact with a plug when being inserted or withdrawn.

However, equipping such a slide contact device with a jack of the type for retaining a rotary plug has inevitably caused the jack design to be of a large size and of involved internal structure, which sometimes threatened reasonable designs for a rotary retainer device, hence loss of the basic function as the retainer or loss of the simple structure.

SUMMARY OF THE INVENTION

This invention is designed to overcome such disadvantages in the conventional art and provide a jack of the type of performing the retention for a rotary plug as well as actuating on-off switch actions based on a simple design, hence resulting in less cost.

The inventive jack comprises a jack main casing which is structured to retain a plug inserted thereinto to be freely rotatable without rotation of the casing, the plug being formed with a cylindrical trunk having a headed end and a neck, wherein spring contact leaves are arranged on the casing to contact the rotary plug, said inventive jack further comprising a leaf spring type switch which is mounted on a rear end cover to be assembled to receive the plug head, wherein the plug is adapted to be inserted into the jack assembly head first, whereby the leaf spring switch is pressed by the plug head end to make a switch on.

As summarized above, the rear cover which is to be assembled with the jack casing to form an end wall is mounted with a switch, wherein the rear cover provided to make switch action will not interfere with the contact of the plug trunk with the contact leaves, hence the safe electrical connection is carried out including a switching action as well as a plug-jack conntection. In other words, the two actions of the connection and the switch-on are concurrently attained.

Figure 1:
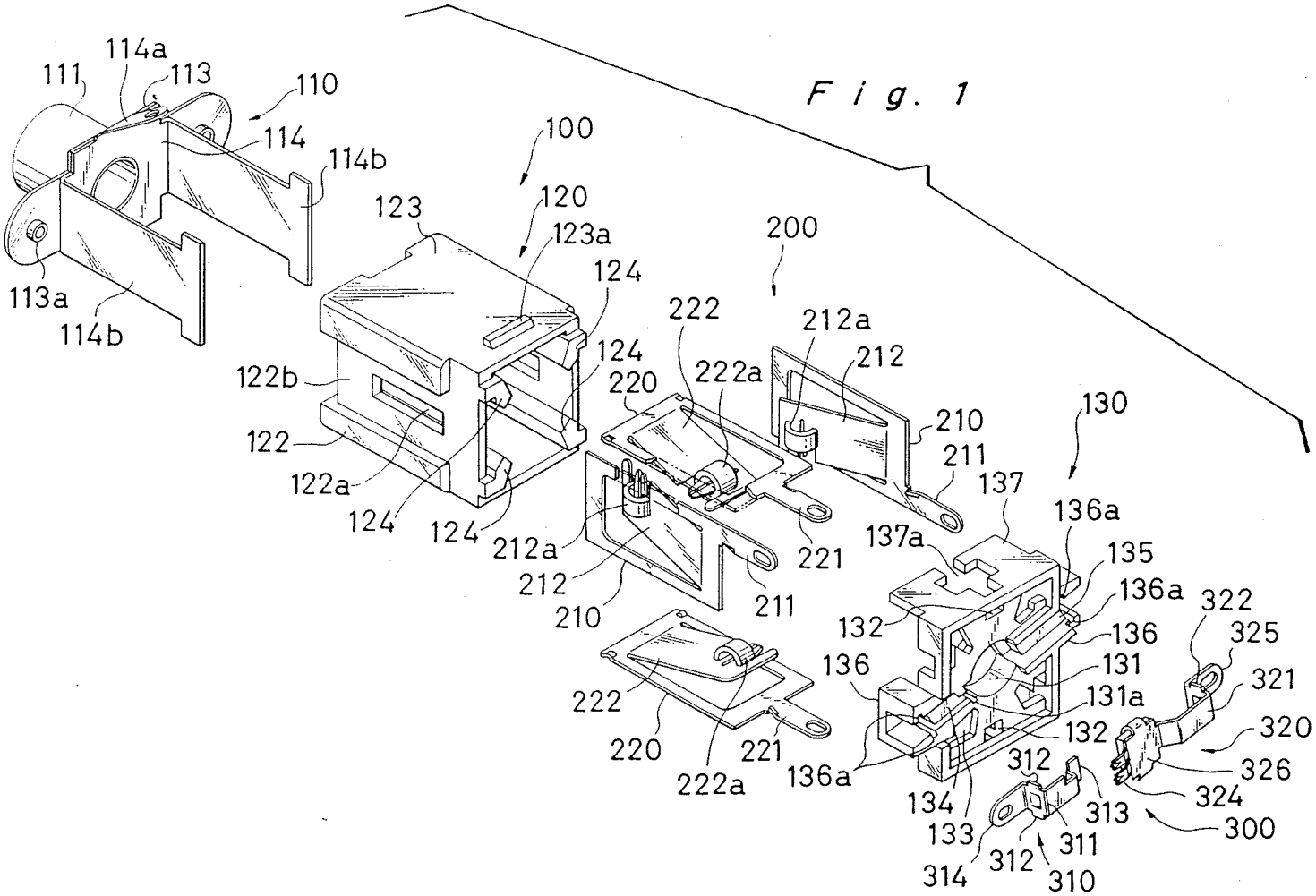
FIG. 1 shows an exploded perspective view of the inventive jack assembly.

These drawings are presented by way of illustrating the inventive embodiment(s) and therefore these should not be construed as limiting the invention.

DESCRIPTION OF THE EMBODIMENT(S)

The invention will be explained with reference to the drawings, wherein the inventive jack assembly 100 is shown as comprising a sleeve unit 110, a jack casing 120, leaf contact frames 200, a rear cover 130, and a switch unit 310, 320, in addition to a plug 400.

Figure 2:
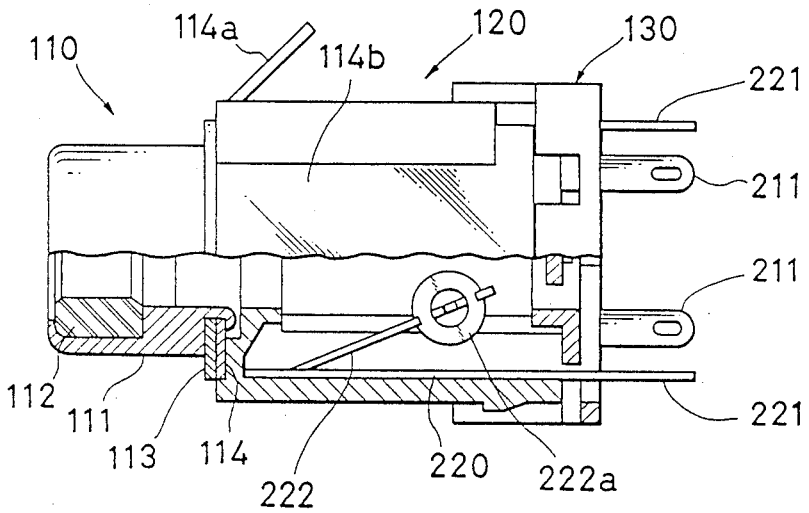
FIG. 2 shows a half-sectioned side view of the jack assembly.

In the drawings, mainly in FIG. 1, the sleeve unit 110, which will be positioned in the front of parts to be assembled, is provided with a cylindrical sleeve 111 which will receive the plug 400 on its insertion, and inside the sleeve 111 there is provided an annular groove containing a slide tube 112 (see FIG. 2), which is made of an oil impregnated metal, for instance, processed from a sintered copper or some bearing alloy, wherein the slide tube 112 is formed to have an inner diameter slightly larger than an outer diameter of the plug 400 to be insertible. And the sleeve 111 is at its rear end secured to a sleeve retainer plate 114 which is fitted with a jack fastening plate 113 by calking, the sleeve plate 114 being held between plate 113 and sleeve 111. The fastening plate 113 is provided at its center with a hole to pass the plug 400 and is formed at its two sides with screw holes **113*a*, and the sleeve plate 114, shaped generally like a U letter, is provided at its center with a hole to pass the plug and also with a grounding terminal 114*a*. A pair of legs 114*b* of the sleeve plate are extended rearward, and engage two outer sides of the casing 120**, as will be apparent later.

The casing 120, made of a plastic material, is generally shaped to be a cubic box opened at its front and rear ends to pass the plug. Of four longitudinal side faces of the casing 120, two opposite side faces 122 are each provided with slots **122*a* and thereon generally T-letter shaped shallow guideways 122*b* are formed on the two sides to fit the paired legs 114*b* of the sleeve unit 110, which will be thereby connected with the casing 120, locating the sleeve unit 110 at the front of the casing assembly. On the two other side faces 123, upper and lower sides, drags (in FIG. 1, one of them is shown on the upper side) 123*a* are formed to engage and to fasten to the rear cover 130 as will be apparent later. Inside the casing 120, four longitudinal rails 124 are formed at each corner so that guideways thus formed between four inside faces and the rails 124 will each serve as slots to receive and to retain four pieces of the leaf contact frames 200 as seen in FIG. 1** and as will be apparent later.

The flapped frames 200, which have been each made by punching a bronze plate to retain flexibilty, are grouped, for convenience in description, to a first two frames, 210 and a second two frames, 220, each of which is similarly formed with a contact flap like a door opened ajar from a frame and is designed to slide into a slot of the casing 120 as noted above, wherein each of the first two pieces 210, 210 is formed to have an end 211 at its rear side of the frame and to have the flap 212 angled from the same rear side so as to angle inward toward the casing interior, wherein on each leaf 212, at its end, a generally E letter shaped recess is formed, around which is fastened a small ring 212*a*, made of an oil impregnated metal. Each ring 212*a* is held to be at right angles to the longitudinal axis of the plug 400 so that the rings 212*a* each will contact with the plug surface without impediment to its turning. Therefore, as the contact frame 210 is moved to enter into the slot of the casing 120, the ring 212*a* proceeds to take a position for contact around the trunk 410 of the plug. In the meantime, said slot 122*a* on the casing side is meant to avoid an impediment to the entering ring 212*a*.

As for the remaining second two pieces 220, 220, the leaves 222 are each formed in a similar shape, but are angled from the front side of the frame, differently from the pieces 210, and therefore the rings 222*a*, made of an oil impregnated metal, each take a position slightly rearward as compared to the rings 212*a*, a slightly different position along the longitudinal axis of the plug 400 so as to contact on the neck 420 (not head end) of the plug. Therefore, positions taken by each pair of the flapped frames 210, 220 are opposite or symmetrical and mutually at right angles.

The rear cover 130, which will engage to the rear of the casing 120, has been made of a plastic similar to the casing 120, and is provided at its center with a hole 131 to have the plug head received therein and at its upper and lower ends with two slots 132 to pass each of the ends 221 of the frames 220, and further provided are slots 133 each at four corners thereof which will align with the ends of the rails 124 of the casing 120, thereby the cover 130 will take its aligning position to the casing 120. Two slots for receiving the ends 211 of the frames 210 are also provided similar to those for the ends 221 as noted above, but not indicated specifically in the drawings.

In addition, on the rear face of the rear cover 130, two grooves 134, 135 are formed across the hole 131 at the center, wherein specifically the grooves 134, 135 are located on a line through the center of the cover 130 and said line is not at right angles, but oblique to two sides of the rear face, and each groove 134, 135 is communicated with the center hole and is extended outward to corner around the side to form an angled extension, which is named a holding mount 136 to hold the switch unit as will be apparent later. Thus each groove 134, 135 forms a generally L letter shape in plan view, wherein each holding mount 136 has another side groove 136*a* to retain a part of the switch unit. On the remaining two sides of the rear cover 130 having no holding mounts 136, there are provided cover flanges 137 each having a keyhole 137*a* which will lock with each of the drags 123*a* formed on the casing 120 as will be appatent later.

The switch unit 300, which will be mounted in the grooves 134, 135, and the mounts 136, comprises a first segment 310 and a second segment 320, each of which has been made by punching a metal plate. The first segment 310 to be mounted in the first groove 134 has a L letter shaped portion 311, wherein at the angled side thereof, two ends 312, facing upward and downward, are formed to engage with recesses 136*a* formed on the holding mount 136, thereby the first segment 310 will be fitted in the first groove 134. Further, one end of the first segment 310, which will be applied to the center of the rear cover, has a contact mount 313 and this mount 313 will be received in a cut 131*a* which is formed by cutting a portion of the perimeter of the center hole 131, and the other end of the same segment 310 is formed to be a contact end 314 which will be exposed outside.

Figure 3:
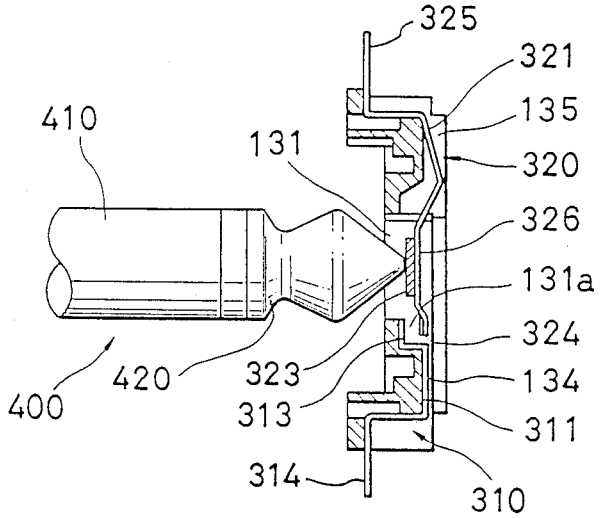
FIG. 3 shows a side view to detail the switch unit.
Figure 4:
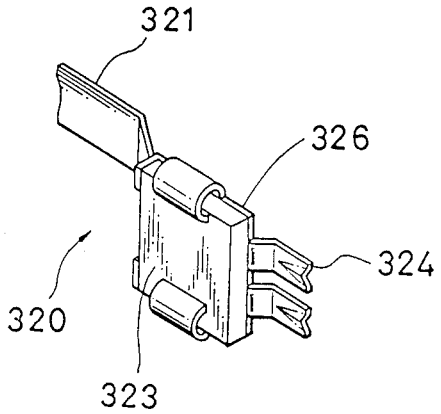
FIG. 4 shows a persective view of an element which forms a portion of the showing of FIG. 3.
Figure 5:
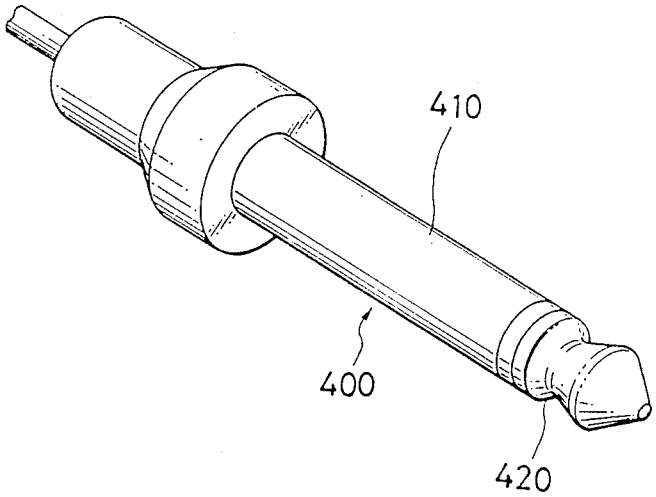
FIG. 5 shows a perspective view of a plug.

The second segment 320, which will be fitted in the second groove 135, has likewise a L letter shaped portion 321 and two ends 322, facing upward and downward, which will engage with the side groove 136*a*, and thereby the second segment 320 will be fitted in the groove 135. Further, one end of the second segment 320, named a plug contact mount 326, will be positioned at the center of the hole 131. As for the plug contact mount 326, at its front side, an insulating plate 323, made of a fluorine resin having a good wear resistance, is attached (see FIG. 3), and at an end of said mount 326, two contact fingers 324 are formed, which are designed to press, while no external pressure is applied or kept free, the rear face of the contact mount 313 of the first segment 310 for forming a closed contact with the first segment. On insertion of the plug 400, the front head end of the plug 400 is designed to press the contact mount 326 of the second segment 320 rearwardly to open the contact between the first and second segments formed by the mount 313 and the fingers 324. Further, an end contact 325 formed at the other end of the L portion 311 is designed to be exposed outside.

Turning to assembling the jack assembly 100 described hereinabove, the procedures will be noted as below:

First, four pieces of the spring leaf contact frames 210, 220 are entered into the casing 120 so that the four frames are retained therein in place as noted, and the sleeve unit 110 is engaged to the casing 120 by engaging the legs 114*b* with the guideways 122*b* of the casing 120, whereby the sleeve unit is combined at the front of the casing 120. Then, the rear cover 130 which has previously been mounted with the switch unit 300 is coupled with the assembled casing 120 by locking the keyholes 137*a* of the cover flanges 137 to the drags 123*a* of the casing 120, wherein the two legs 114*b* of the sleeve unit 110 are embraced by corners of the holding mounts 136 of the rear cover 130 to contribute further fastening pressure to the casing and the four ends of the leaf contact frames, 211, 211, 221, 221, are exposed rearwardly from the rear side of the cover 130 through the slots 132, 133.

Then, referring to the function of the assembled jack 100, while the plug is not inserted into the jack, the switch unit 300 mounted with the rear cover 130 is kept in contact. That is, due to elasticity like a leaf spring of the second segment 320, as noted above, the fingers 324 of the second segment are pressed on the mount 313 of the first segment 310, thereby the contact end 314 of the first segment 310 is communicated to the contact end 325 of the second segment 320. Therein, as noted, the first and second grooves 134, 135 are formed to be not at right angles to four sides of the rear face, which contributes to formation of a longer leaf span and more spring elasticity, wherein this improvement is aided by the leaf which is held with the two ends 322, and positioning of the mount 326 which is received in a cut formed in the perimeter of the hole 131 has reduced a thickness of the rear cover 130 and has improved the elastic retentivity thereof.

When the plug 400 is inserted into the jack assembly 100, the paired rollers 212*a* mounted on the frames 210 and likewise the paired rollers 222*a* of the frames 220 contact the plug 400 at slightly different points, for instance, the rollers 212*a* are on the trunk 410 and the rollers 222*a* are on the neck 420 thereof, wherein each roller is disposed to be at right angles to the longitudinal axis of the plug and therefore, no impediment will take place to the plug, and smooth rotation of the plug, due to contacts of an impregnated metal of the flaps, is ensured during operation, and possible contact of the roller 212*a* against the inner wall is prevented with aid of the slot 122*a*.

Further, insertion of the plug 400 into the jack assembly 100 causes a switch action at the switch unit 300. Speicifically, when the head end of the plug 400 is contacted to the insulation plate 324 mounted on the mount 326 of the second segment 320, the fingers 324 of the second segment 320 leave the mount 313 of the first segment 310, which breaks the contact between the two segments and concurrently a contact of the plug 400 to the insulation plate 323 is made, which will not impede rotation of the plug. On withdrawing the plug 400, the contact between the first and second segments will be re-formed or become conductive. And therein, an alternative way of making a contact on insertion of the plug, contrary to the illustrated embodiment, is allowed by changing connections of the terminals and the number of switching actions may be increased by incorporating more than one switch.

Further, rollers 212*a* may be designed to contact with the legs 114*b* of the sleeve unit 110 through the slots 122*a*, in which case the sleeve unit 110 is made conductive from the rollers 212*a*, and therefore, the terminals or ends 211 mounted on the contact frames 211 may be dispensed with.

What is claimed is:

1. An electrical jack assembly for connecting a rotary plug having a cylindrical trunk and a head end, said jack comprising:

a casing having a front end and a rear end;

a sleeve unit affixed to said casing front end, said sleeve unit having a cylindrical sleeve formed with a central bore for insertion of a cylindrical trunk of a plug;

two pairs of electrically conductive spring leaf contact frames positioned within said casing, said frames having leaves angled inwardly, each being provided with an oil-impregnated roller at an end arranged to contact the trunk of a plug inserted into said cylindrical sleeve at right angles to a longitudinal axis of the plug; and a rear cover affixed to said casing rear end, said rear cover having a central hole positioned to receive a head end of an inserted plug and having a switch unit mounted thereon, wherein said switch unit comprises a first segment mounted externally of said rear cover and having a contact positioned adjacent a perimeter of said central hole, and a second resilient segment mounted externally on said rear cover having an insulating plug contact mount positioned at said central hole and a contact formed at an end thereof so as to resiliently engage said contact of said first segment, such that a head end of a plug inserted in said cylindrical sleeve passes through said central hole to make contact with said insulating contact mount causing actuation of said contacts of said switch unit first and second segments.

2. An electrical jack assembly as set forth in claim 1, wherein one of said pairs of contact frames is positioned to have its rollers contact said plug trunk at a neck thereof, at a position where said plug head end will hold said switch unit contacts in an actuated condition when engaged by said rollers.

3. An electrical jack assembly as set forth in claim 1, wherein said casing is of generally cubic shape, and said switch unit segments extend obliquely across said rear end.

4. An electrical jack assembly as set forth in claim 1, wherein said rear cover affixed to said casing is formed so as to hold said sleeve unit, said contact frames and said first and second contact segments in an assembled condition.

* * * * *